United States Patent [19]

Lee

[11] Patent Number: 4,975,711

[45] Date of Patent: Dec. 4, 1990

[54] SLOT ANTENNA DEVICE FOR PORTABLE RADIOPHONE

[75] Inventor: Kang-Hoon Lee, Suwon, Rep. of Korea

[73] Assignee: SamSung Electronic Co., Ltd., Maetan-Dong Suwon, Rep. of Korea

[21] Appl. No.: 356,698

[22] Filed: May 25, 1989

[30] Foreign Application Priority Data

Aug. 31, 1988 [KR] Rep. of Korea ..... 1988-11198

[51] Int. Cl.[5] ..... H01Q 1/24

[52] U.S. Cl. ..... 343/702; 343/767; 343/770

[58] Field of Search ..... 343/702, 767, 770, 768

[56] References Cited

U.S. PATENT DOCUMENTS

| | | | |
|---|---|---|---|
| 2,687,475 | 8/1954 | Scheldorf | 343/767 |
| 3,183,511 | 5/1965 | Ajioka | 343/767 |
| 4,410,890 | 10/1983 | Davis et al. | 343/767 |
| 4,723,305 | 2/1988 | Phillips et al. | 343/702 |

FOREIGN PATENT DOCUMENTS

| | | | |
|---|---|---|---|
| 0103406 | 6/1982 | Japan | 343/767 |
| 0104504 | 6/1983 | Japan | 343/767 |

*Primary Examiner*—Rolf Hille
*Assistant Examiner*—Hoanganh Le
*Attorney, Agent, or Firm*—Robert E. Bushnell

[57] ABSTRACT

An antenna device of an easily carried portable radiophone, is provided, by disposing a slot antenna within an interior of the portable radiophone. The antenna device improves sensitivity of the device by arranging a slot antenna so as to transmit and receive vertical- and horizontal-polarized waves through the slot antenna device, which is constructed such that a conductive material is coated on a case of the portable radio telephone, an omni-directional first slot antenna for a vertical-polarized-wave is disposed horizontally over said case, and a second slot antenna for slant vertical-polarized or horizontal-polarized waves is disposed in a predetermined angle below said case, thereafter coupling in parallel a coaxial cable for feeding an electrical signal between each given position on the first and second slot antennas.

20 Claims, 6 Drawing Sheets

COMPLEMENT ANTENNA

EQUIVALENT CIRCUIT

SLOT ANTENNA

SLOT ANTENNA DEVICE FOR PORTABLE RADIOPHONE

BACKGROUND OF THE INVENTION

The present invention relates to a protable radiophone, and in particular to a slot antenna device adoptable to an interior of a portable radiophone.

A portable radiophone employs basically a monopole antenna device utilizing a vertical polarized-wave or else a patch antenna device combined therewith. In the latter case, since the patch antenna is narrow in bandwidth and low in gain, it is utilized mainly for receiving only, while the monopole antenna or a whip antenna device is utilized for both transmitting and receiving. The monopole and whip antennas are antennas which are projected outward of a portable radiophone, which require a length more than at least ¼ wave length in order to obtain enough antenna efficiency therefrom. However, since such an antenna has an externally projected form, it can be often damaged and inconvenient for carrying, and its antenna gain also has limitation due to its limited antenna size. Moreover, since the portable radio telephone should be often used in a tilted position of apparatus, a slant vertical-polarized wave is to be transmitted and received through its antenna. However, since the external antenna is an antenna utilizing the vertical polarized wave, sensitivity deteriorates at about horizontal position of the antenna, thereby giving a problem that an effective transmitting and receiving of radio signals may not be made through the antenna.

SUMMARY OF THE INVENTION

Therefore, an object of the present invention is to provide an antenna device of a portable radiophone, easy to carry, by disposing a slot antenna within an interior of the portable radiophone.

Another object of the present invention is to provide an antenna device capable of improving a sensitivity of the device by arranging a slot antenna so as to transmit and receive both vertical- and horizontal- polarized waves through the slot antenna device.

Still another object of the present invention is to provide an antenna device of a portable radiophone capable of compensating a reactance component value of a slot antenna itself by stub matching.

According to one aspect of the present invention, a slot antenna device for use in a portable radiophone (radio telephone) is constructed such that a conductive material is coated on a case of the portable radio telephone, an omni-directional first slot antenna for a vertical-polarized-wave is disposed horizontally over said case, and a second slot antenna for slant vertical-polarized or horizontal-polarized waves is disposed in a predetermined angle below said case, thereafter coupling in parallel a coaxial cable for feeding an electrical signal between each given position on the first and second slot antennas.

BRIEF DESCRIPTION OF THE DRAWINGS

For a better understanding of the invention and to show how the same may be carried into effect, reference will now be made, by way of example, to the accompanying diagrammatic drawings, in which.

DETAILED DESCRIPTION OF THE INVENTION

The present invention will be described in detail with reference to the accompanying drawings as follows.

Figure 1C:
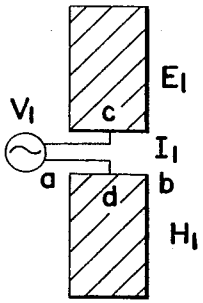
FIGS. 1A to 1C are schematic diagrams illustrating the relation between input voltage and current of a slot antenna and a dipole antenna.
Figure 1B:
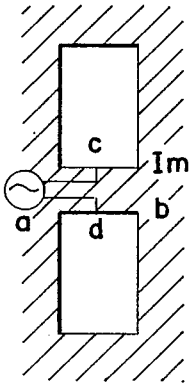
Figure 1A:
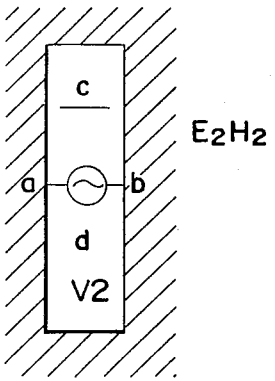

Firstly, a slot antenna, as shown in FIGS. 1A to 1C, has basically a complemental relation with a dipole antenna. For example, FIGS. 1A to 1C are schematic diagrams illustrating the complemental relation between the slot antenna and the dipole antenna, in which FIG. 1A is the slot antenna, FIG. 1B is an equivalent circuit diagram of FIG. 1A for seeking a current source Im, and FIG. 1C represents an antenna device complemented with the slot antenna and the dipole antenna. Mutual change of the direction of electromagnetic fields with respect to the slot antenna and the dipole antenna can be expressed as below, according to Babinet's principle:

$I1 = Im$ $E2 = -H1$ $E1 = Zo^2 \cdot H2$ $V2 = -\int_a^b E_2 dl$ $V1 = -\int_d^c E1 dl$ Here, a current distribution I1 of dipole antenna is expressed by an equation (1) as below according to a circular integration H1 of a conductor surface at feeding points a, b.

$$I1 = \phi\, H1\, dl = 2\int_a^b H1\, dl \quad (1)$$

When I1 of the above equation (1) is changed to a current source Im, and subtituted with $H1 = -E2$ according to the Babinet's principle, an equation (2) comes out.

$$Im = 2\int_a^b E2\, dl \quad (2)$$

And, since $V2 = -\int_a^b E2\, dl$ according to the Babinet's principle, the equation (2) is derived to an equation (3) as below:

$$Im = 2\, V2 \quad (3)$$

As it may be understood from the above process, radiation of the slot antenna is almost the same as that of the dipole antenna. However the vector directions of the electric and magnetic fields come out in changing each other. Therefore, when the slot is arranged vertically, the electric field becomes a horizontally polarized wave, while when the slot is arranged horizontally, it becomes a vertical polarized wave. Here, when the size of a metal sheet becomes infinitely large, the slot becomes to have a similar characteristics with the dipole anenna.

And next, let's seek an input impedance of the slot antenna from the above FIGS. 1A to 1C. Expressing V2, I2 of FIG. 1A into V1, I1 of FIG. 1C, it becomes an equation (4) as below, according to Babinet's principle, as similar as the equation (3):

$$I1=2\ V2 \tag{4}$$

Since said V1 is $V1=-\int_d^c E1\ dl$ from FIG. 1C, being transferred to FIG. 1A by using Babinet's principle, it can be expressed as an equation (5) as below:

$$V1 = -\int_d^c E1\ dl = -Z0^2 \int_d^c H2\ dl = Z0^2 \int_c^d H2\ dl = Z0^2 \frac{I2}{2} \tag{5}$$

Seeking the impedances Z1, Z2 by using the above equation (4) and (5), they become as following equation (6), (7):

$$Z1 = \frac{V1}{I1} = \frac{Z0^2 \cdot I2}{2} \cdot \frac{1}{I1} = \frac{Z0^2}{4} \cdot \frac{2I2}{I1} = \frac{Z0^2}{4} \cdot \frac{I2}{V2} \tag{6}$$

$$Z2 = \frac{V2}{I2} = \frac{Z0^2}{4Z1} = \frac{(120\pi)^2}{4Z1} = \frac{(60\pi)^2}{Z1} \tag{7}$$

As may be understood from the above description, the impedances of the slot antenna are able to be obtained from the impedance equations sought from the complementary symmetrical antenna.

When feeding with a coaxial cable after seeking an input impedance of the slot antenna according to above equations (6), (7), since a characteristic impedance of said coaxial cable is very low (50 Ω), the location of a feeding point of the slot antenna is selected at a location out of a center of the slot for impedance match. The reason is that, when the feeding point is got out of center, the input current increases while the voltage decreases. Therefore the input impedance of the slot antenna can be reduced.

The effect of the slot width to the impedance renders an equation (8) as below, with radius (a) of the dipole antenna:

$$W=4a \tag{8}$$

That is to say, as the above equation (8), an equivalent radius of band-shaped antenna of the slot width W corresponds to the dipole antenna of 0.25 W.

By applying a principle of the slot antenna described as above, a slot antenna device being usable both with the vertical and horizontal polarized waves in the portable radiophone according to the present invention will be explained as follows.

Figure 2:
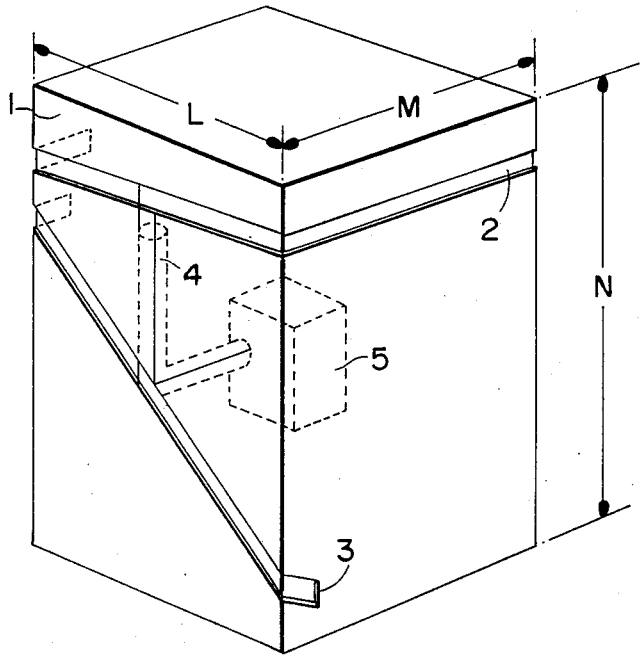
FIG. 2 is a perspective view of the slot antenna device applied to a portable radiophone according to the present invention.

According to the present invention, as shown in FIG. 2, one embodiment is constructed in such a manner that a conductive material is coated on a case 1, an omnidirectinal, first slot antenna 2 for vertically-polarized waves is horizontally arranged at the upper portion of said portable radiophone case 1, a second slot antenna 3 for slant vertically-polarized or horizontally-polarized waves is arranged to be inclined with a predetermined angle at the lower portion of the case 1, and thereafter a coaxial cable 4 for feeding is from a source 5 connected in parallel.

Figure 3A:
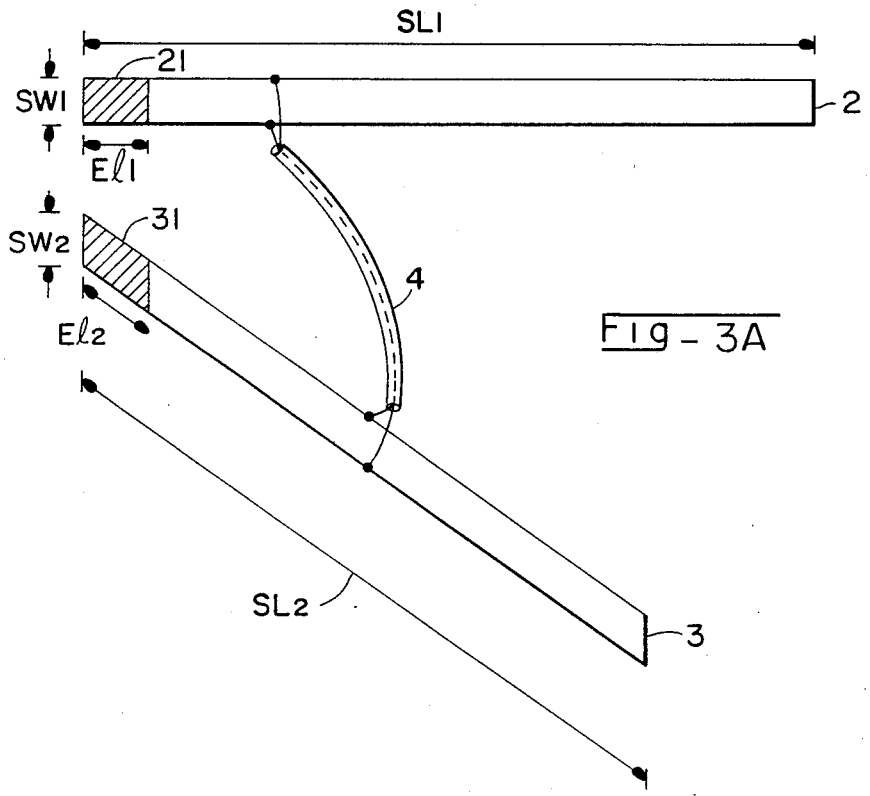
FIGS. 3A and 3B show arrangements of the slot antenna of a portable radiophone according to the present invention.
Figure 3B:
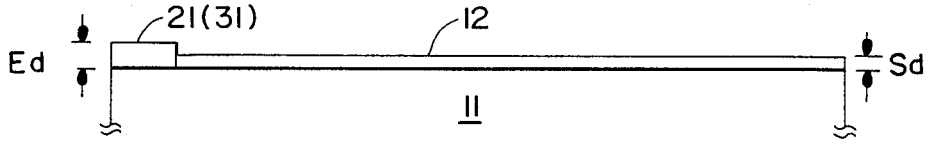

FIGS. 3A and 3B are schematic diagrams illustrating the connection of the first and second slot antennas 2, 3, in which FIG. 3A shows each dimensions of the first slot antenna 2 and second slot antenna 3, and FIG. 3B shows each sectional view of the first and second slot antennas 2, 3.

Figure 4:
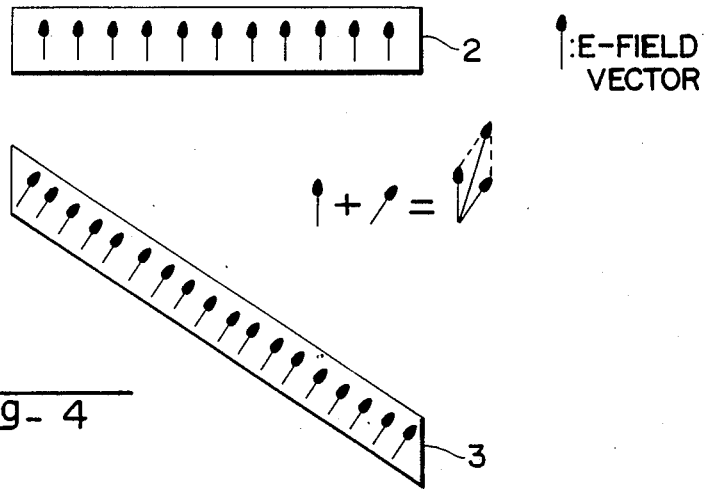
FIG. 4 is a distribution diagram of a radiative electromagnetic field of the slot antenna according to the present invention.

FIG. 4 is a distribution diagram of radiative electromagnetic field for said FIG. 2 and FIGS. 3A and 3B, in which an arrow 1 represents vectors of electromagnetic field (E field vector), and the first slot antenna 2 is applied for the vertical polarized wave, while the second slot antenna 3 is applied for the slant vertical polarized wave or horizontal polarized wave.

Figure 5:
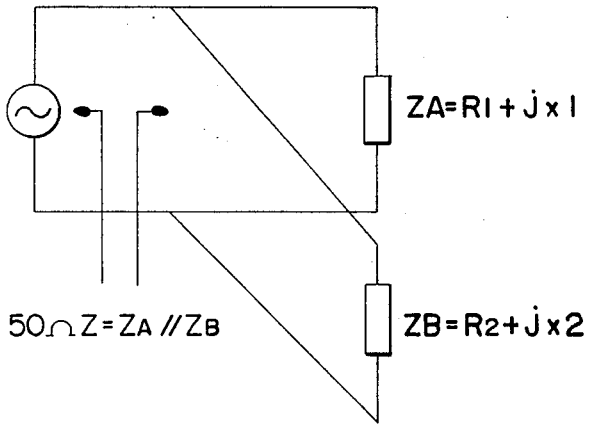
FIG. 5 is an equivalent circuit diagram of a parallel connection of the slot antenna according to the present invention.

FIG. 5 is an equivalent circuit diagram of a parallel connection of the first and second slot antennas 2, 3, in which ZA, ZB show the radiation impedances, wherein a real number part R means a radiation resistance, while an imaginary number jx means a radiation reactance, and when the antennas 2, 3 are connected in parallel, the matching should be implemented with the characteristic impedence (50 Ω coaxial cable) of the feeding line and the input impedance (Z=ZA//ZB) of the antenna.

Figure 6:
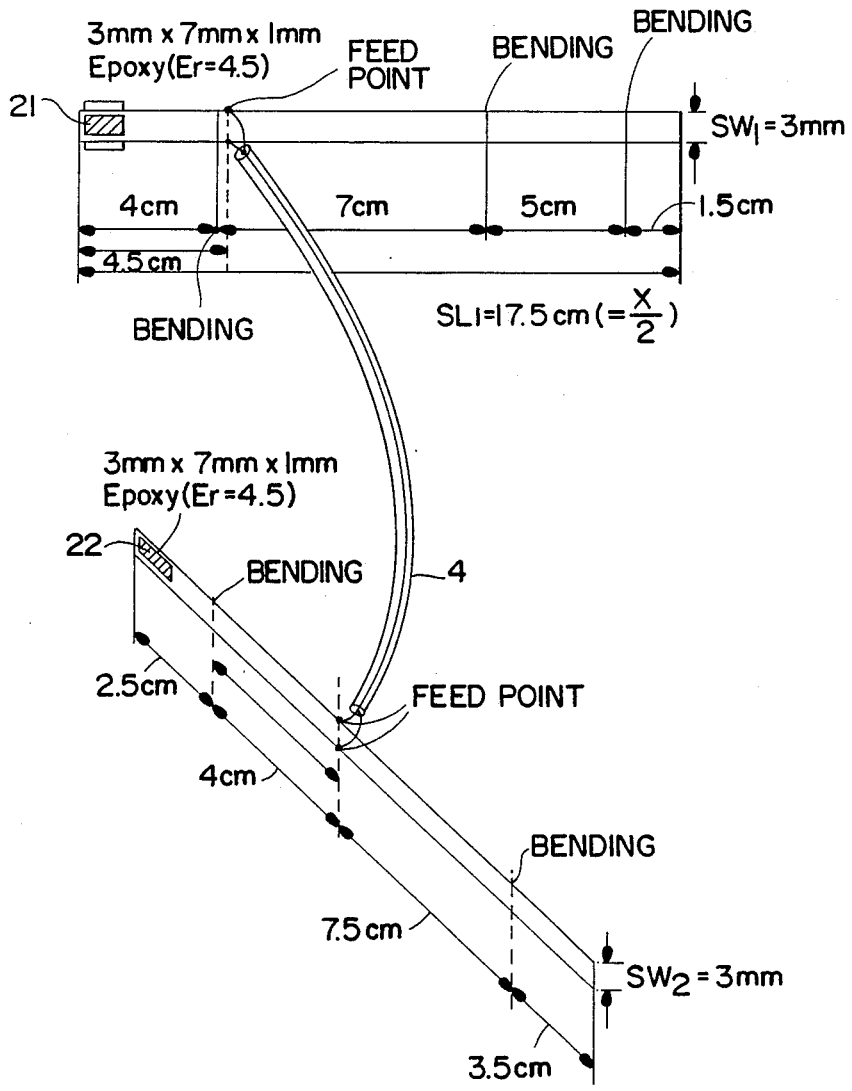
FIG. 6 shows schematically a preferred embodiment of the slot antenna of a portable radiophone according to the present invention.

FIG. 6 shows a preferred, but not restrictive, embodiment with respect to the slot antenna of the portable radiophone according to the present invention.

The slot antenna device of the above portable adiophone according to the present invention will be explained with reference to the drawings aforementioned.

A base station operating portable radiophones generally employs the vertical polarized wave. Practically, though an user of the portable radiophone may use the phone itself with its position vertical, generally the phone is used by inclining it with some degrees of tilting. Therefore, in order to receive the vertical polarized wave from the base station without loss, the slot antenna arrangement of the portable radiophone is preferably constructed with an antenna capable of receiving the vertical polarized wave, as well as an antenna capable of receiving the radio signal with the slant vertical polarized wave or the horizontal polarized wave upon using phone itself with inclining. Thus, it is preferable to construct the antenna so as not to have the effect resulting from vertical and horizontal deflection.

In FIGS. 3A and 3B, first slot antenna 2 can receive the incident vertical polarized waves without any deterioration of sensitivity in case of utilizing the portable radiophone standing vertically, and the second slot antenna 3 is constructed so as to be able to receive the slant vertical polarized wave or the horizontal polarized wave without any deterioration of sensitivity in case of using the portable radiophone with slant or horizontal position. First and second slot antennas 2, 3 are, as in FIG. 3B, coated with a conducitive material 12 on a plastic case 11 of the portable radiophone, and stubs 21, 31 are attached to the edge portions to compensate the reactance component included in the slot antennas themselves for impedance matching. The conductive material 12 is copper or aluminum, whose thickness may be suitable if the skin effect can be satisfied (in case of a copper:

$$\delta = \frac{6.64}{\sqrt{f}} \text{ cm} \Big).$$

The slot on the conductive material 12 may be either constructed by etching the conductive material 12 deposited on the using internal surface of the plastic case 11, or by using so-called sputtering method of depositing the conductive material 12 on the internal wall of the plastic case 1 except for the slot after making the slot-shaped pattern on the plastic case 1.

The antenna dimension such as the length, width, and the decision of a location for feeding point of the slot antennas 2, 3 will be explained hereinbelow. The length in a slot antenna is determined in accordance with the wave length, in which an appropriate slot width should be determined for the impedance matching because, when the width is wider, then the impedance becomes less, and when narrower, the impedance becomes larger. Further, the impedance becomes largest when the location of the feeding point is at a center, and the impedance becomes lower when the location of the feeding point is offset toward each end portion. Thus, it should be preferrably arranged to feed at the location where the impedance matching is easy to be done.

At first, a basic length of the slot is based upon the length of $$\frac{\lambda}{2},$$

and is changed depending upon the adopted frequency band as an equation (9) as below:

$$\lambda = c/f \tag{9}$$

The lengths SL1, SL2 of the first and second slot antennas 2, 3 are each sought by equation (9). Then, the widths SW1, SW2 of the first and second slot antennas 2, 3 are sought according to equation (8) being based on the dipole antenna element, in which the impedance matching is taken by selection of an appropriate width because the width affects the impedance.

Thereafter, since the feeding to a center makes the impedance higher upon determining the locations (a, b) of the feeding point, it may be fed at the locations being deviated suitably from the center. At this moment, since the first and second slot antennas 2, 3 are connected in parallel as shown in FIG. 6, it will be preferably applied by a method so that a feeding point is located at the center position of any one slot antenna among the first and second slot antennas 2, 3, thereafter seeking a feeding point of the other slot antenna. Thus, the inventive device is adapted to locate one feeding point at a center position of the second slot antenna 3, and thereafter the first slot antenna 2 is made to be fed at the location having the similar impedance value with the characteristic impedance of the feeding line at a desired frequency. In addition, since the slot itself includes the reactance component jx as shown in FIG. 5, the reactance component is reduced by respectively attaching the stubs 21, 31 at the edge portions of the slot in order to compensate for such a reactance component, and the impedance matching is executed by controlling the location of feeding points.

Here, for example, with a portable radiophone having the dimension of 7 cm in longitudinal length L, 5 cm in lateral length M, and 20 cm in height N, in case of utilizing the coaxial cable 4 whose characteristic impedance is 50 Ω for a feeding line, at 835 MHz in frequency, the inventive slot antenna and its dimension will be further explained hereinbelow.

The lengths SL1, SL2 of the first and second slot antennas 2, 3 become about $$17.9 \text{ cm} \left( = \frac{3 \times 10^{10}}{2 \times 835 \times 10^{6}} \right)$$

in accordance with equation (9). And, the slot widths SW1, SW2, when 0.75 mm dipole antenna element is taken for reference becomes 3 mm ($w = 0.75 \times 4$).

Then, the location of the feeding point will be determined, wherein when it is assumed that input impedance of the λ/2-dipole antenna corresponds to 75 Ω (Z1), the characteristic impedance Z2 of the slot antenna responding to this, is as follows:

$$\text{since } Z2 = \frac{(60\pi)^2}{Z1},\ Z2 = \frac{(60\pi)^2}{75} \doteqdot 473\Omega$$

Here, the measured impedance ZB becomes about 300 Ω in case of feeding at the location (11.5 cm) adjacent to the center of the antenna 3. Since the parallel impedance value of the first and second antennas 2, 3 should have the same impedance value with the characteristic impedance of the coaxial cable 4, the desired impedance value ZA is sought by controlling the feeding point of the slot by deviating a little out of the center in order to obtain the location of the feeding point of the first slot antenna 2.

Thereafter, the radiation reactance value contained in a slot itself should be offset, and when a Smith chart is utilized, this value is sought as an equation (10) below by the measurement:

$$C1 = \frac{1}{2\pi f \cdot xc} = \frac{1}{835 \times 10^{6} \times 2\pi \times 50 \times 0.5} \simeq 7.4 \text{ pf} \tag{10}$$

wherein

C1: capacitance contained with the slot itself,
f: 835 MHz,
50: Normalization factor of the Smith chart,
0.5: Radiation reactance value by the measurement.

In order to compensate the impedance value in accordance with the inherent capacitance value contained within the slot itself, taken from the equation (10), the stubs 21, 31 of a material such as epoxy resin are employed. In case that stubs 21, 31 are applied with epoxy resin, the radiation reactance value can be compensated as an equation (11) as below:

$$C2 = \frac{\epsilon o \cdot \epsilon r \cdot A}{d} \tag{11}$$

wherein C2 is a serial capacitance value attributable to the stub matching.

According to the values of equations (10) and (11), a total reactance value becomes C1/C2. Thereby, the imaginary value which is the radiation reactance can be minimized. In making the inventive slot antenna device for use in the portable radiophone with the dimensions as aforementioned, a preferred embodiment of each dimension of the slot antenna is shown in FIG. 6.

Figure 7:
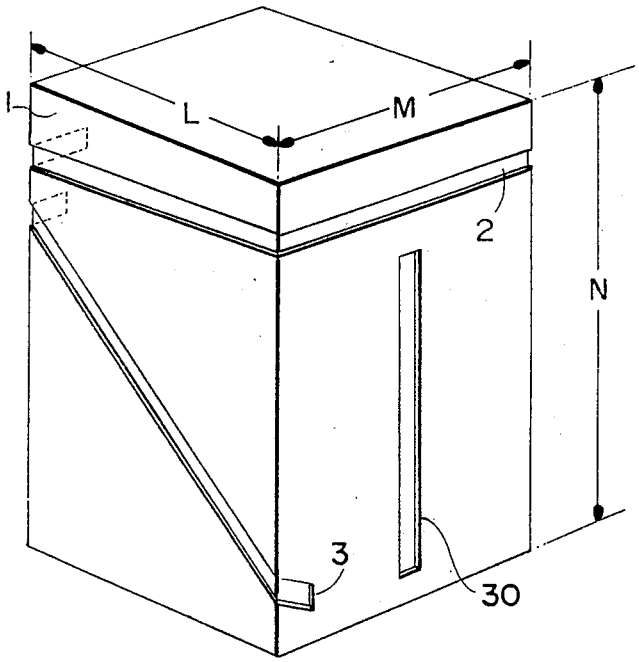
FIG. 7 is a perspective view of the slot antenna device applied in an alternative embodiment according to the principles of the present invention.

As understood from the aforementioned description, even though an user takes up horizontally the portable radiophone, the signal of a horizontal polarized wave may be received without any deterioration of the sensitivity, if a third slot antenna 30 (shown in FIG. 7) is vertically arranged further on the portable radiophone.

As described hereinbefore, according to the present invention, a slot antenna for an omnidirectional vertical polarized wave is arranged at an upper portion of the portable radiophone, and another slot antenna for slant horizontal polarized wave is arranged at a lower portion thereof, so that the radio signal can be effectively transmitted and received regardless of the vertical and horizontal deflection. Furthermore, since an external antenna is not used due to disposition of the slot antenna itself within the interior of the portable radiophone, it is convenient for a user to safely use the apparatus.

The foregoing description shows only a preferred embodiment of the present invention. Various modifications are apparent to those skilled in the art without departing from the scope of the present invention which is only limited by the appended claims. Therefore, the embodiment shown and described is only illustrative, not restrictive.

What is claimed is:

1. A slot antenna device for use in a portable radio telephone, characterized in that:

a conductive material is coated on a case of the portable radio telephone, an omni-directional first slot antenna for a vertical-polarized wave is disposed horizontally on said case, and a second slot antenna for slant vertical-polarized and horizontal-polarized waves is disposed in a predetermined angle relative to said first slot antenna, thereby enabling coupling in parallel a coaxial cable for feeding an electrical signal between each position on the first and second slot antennas.

2. A radio antenna, comprising:

a container made of an electrically insulating material, providing an interior cavity exhibiting a longitudinal axis, and having an interior surface of said cavity bearing an electrically conductive material;

first and second discrete and spaced-apart elongate slots formed in an exterior of said container through said insulating material to expose said conductive material to an exterior of said container;

said first slot having a first length lying in a first plane perpendicular to said longitudinal axis;

said second slot having a second lenght lying in a second plane oblique to said first plane and longitudinal axis; and coaxial cable coupling said first and second slots in parallel, said coaxial cable having one end connectable for feeding an electrical signal to said first and second slots.

3. The antenna of claim 2, wherein said container has a rectangular cross-section providing four adjoining planar exterior sides perpendicular to said first and second planes, further comprised of:

said first slot having a first end disposed in a first of said exterior sides, extending continuously across successive second and third of said exterior sides, and terminating with a second end in a fourth of said exterior sides; and said second slot having a third end disposed in said first of said exterior sides, extending continuously across said second said side, and having a fourth end in said third side.

4. The antenna of claim 3, further comprised of said coaxial cable being coupled to said first slot at a location other than a mid-point of said first length.

5. The antenna of claim 4, further comprised of said coaxial cable being coupled to said second slot at a location other than a mid-point of said second length.

6. The antenna of claim 5, further comprised of said first and second lengths being substantially equal in value.

7. The antenna of claim 4, further comprised of said first and second lengths being substantially equal in value.

8. The antenna of claim 3, further comprised of said coaxial cable being coupled to said second slot at a location other than a mid-point of said second length.

9. The antenna of claim 3, further comprised of:

a third elongate slot formed in said exterior of said container, discrete and spaced-apart from said first and second slots, to expose said conductive material to an exterior of said container, said third slot having a third length parallel to said longitudinal axis, said third length lying in a third plane perpendicular to said first plane.

10. The antenna of claim 3, further comprised of first and second layers of a dielectric material disposed upon said electrically conductive material within corresponding ones of said first and second ends.

11. The antenna of claim 2, further comprised of said coaxial cable being coupled to said first slot at a location other than a mid-point of said first length.

12. The antenna of claim 11, further comprised of said coaxial cable being coupled to said second slot at a location other than a mid-point of said second length.

13. The antenna of claim 2, further comprised of said coaxial cable being coupled to said second slot at a location other than a mid-point of said second length.

14. The antenna of claim 2, further comprised of:

a third elongate slot formed in said exterior of said container, discrete and spaced-apart from said first and second slots, to expose said conductive material to an exterior of said container, said third slot having a third length parallel to said longitudinal axis, said third length lying in a third plane perpendicular to said first plane.

15. The antenna of claim 2, further comprised of first and second layers of a dielectric material disposed upon said electrically conductive material within corresponding ones of said first and second ends.

16. A radio antenna, comprising:

a container made of an electrically insulating material, providing an interior cavity exhibiting a longitudinal axis, and having an interior surface of said cavity bearing an electrically conductive material;

first and second discrete and spaced-apart elongate slots formed in an exterior of said container through said insulating material to expose said conductive material to an exterior of said container;

said first slot having a first length lying in a first plane perpendicular to said longitudinal axis;

said second slot having a second length substantially equal to siad first length, lying in a second plane oblique to said first plane and longitudinal axis; and coaxial cable coupling said first and second slots in parallel, said coaxial cable having one end connectable for feeding an electrical signal to said first and second slots.

17. The antenna of claim 14, wherein said container has a rectangular cross-section providing four adjoining planar exterior sides perpendicular to said first and second planes, further comprised of:

said first slot having a first end disposed in a first of said exterior sides, extending continuously across successive second and third of said exterior sides, and terminating with a second end in a fourth of said exterior sides; and said second slot having a third end disposed in said first of said exterior sides, extending continuously across said second said side, and having a fourth end in said third side.

18. The antenna of claim 17, further comprised of said coaxial cable being coupled to said first slot at a location other than a mid-point of said first length.

19. The antenna of claim 18, further comprised of said coaxial cable being coupled to said second slot at a location other than a mid-point of said second length.

20. The antenna of claim 17, further comprised of said coaxial cable being coupled to said second slot at a location other than a mid-point of said second length.

* * * * *